US011097397B2

(12) United States Patent
Watanabe et al.

(10) Patent No.: US 11,097,397 B2
(45) Date of Patent: Aug. 24, 2021

(54) POLISHING DEVICE, POLISHING METHOD, AND RECORD MEDIUM

(71) Applicant: TOSHIBA MEMORY CORPORATION, Minato-ku (JP)

(72) Inventors: Takashi Watanabe, Yokkaichi (JP); Takeshi Arakawa, Yokkaichi (JP); Hiroaki Hayasaka, Yokkaichi (JP); Tomonori Kawasaki, Yokkaichi (JP); Dai Fukushima, Kuwana (JP)

(73) Assignee: TOSHIBA MEMORY CORPORATION, Minato-ku (JP)

( * ) Notice: Subject to any disclaimer, the term of this patent is extended or adjusted under 35 U.S.C. 154(b) by 299 days.

(21) Appl. No.: 15/915,092

(22) Filed: Mar. 8, 2018

(65) Prior Publication Data

US 2019/0039206 A1 Feb. 7, 2019

(30) Foreign Application Priority Data

Aug. 4, 2017 (JP) ..... JP2017-151878

(51) Int. Cl.

| | |
|---|---|
| ***B24B 49/10*** | (2006.01) |
| ***B24B 49/12*** | (2006.01) |
| ***B24B 37/20*** | (2012.01) |
| ***B24B 37/013*** | (2012.01) |
| ***B24B 37/10*** | (2012.01) |

(52) U.S. Cl.

CPC ..... *B24B 49/10* (2013.01); *B24B 37/013* (2013.01); *B24B 37/107* (2013.01); *B24B 37/20* (2013.01); *B24B 49/12* (2013.01)

(58) Field of Classification Search

CPC ..... B24B 49/10; B24B 37/013; B24B 37/107; B24B 37/20; B24B 49/12

See application file for complete search history.

(56) References Cited

U.S. PATENT DOCUMENTS 5,036,015 A * 7/1991 Sandhu ..... B24B 37/013 216/84
5,069,002 A * 12/1991 Sandhu ..... B24B 37/013 216/38
5,830,041 A * 11/1998 Takahashi ..... B24B 49/16 451/8

(Continued)

FOREIGN PATENT DOCUMENTS

JP H09-070753 A 3/1997
JP 2001-9712 A 1/2001

(Continued)

*Primary Examiner* — Dung Van Nguyen
(74) *Attorney, Agent, or Firm* — Oblon, McClelland, Maier & Neustadt, L.L.P.

(57) ABSTRACT

According to an embodiment, a polishing device which polishes a surface of a polishing target, includes a sensor, an end point detector, and an end point condition setter. The sensor senses a characteristic value correlated with a state of the surface during polishing. The end point detector detects that the characteristic value or a polishing time satisfies an end point condition corresponding to an end point of the polishing. The end point condition setter sets the end point condition in accordance with at least one of device information about the polishing device and polishing target information about the polishing target, and outputs the set end point condition to the end point detector.

12 Claims, 12 Drawing Sheets

(56) References Cited

U.S. PATENT DOCUMENTS

| | | | | |
|---|---|---|---|---|
| 6,046,111 | A * | 4/2000 | Robinson | B24B 37/013 156/345.13 |
| 6,969,306 | B2 * | 11/2005 | Taylor | B24B 37/105 451/41 |
| 7,727,049 | B2 * | 6/2010 | Benvegnu | B24B 37/013 451/285 |
| 8,814,631 | B2 | 8/2014 | David et al. | |
| 9,308,618 | B2 | 4/2016 | Benvegnu | |
| 2002/0055192 | A1 * | 5/2002 | Redeker | G01B 7/105 438/8 |
| 2009/0023361 | A1 | 1/2009 | Matsuzaki | |
| 2017/0282325 | A1 * | 10/2017 | Takahashi | B24B 37/042 |

FOREIGN PATENT DOCUMENTS

| | | | |
|---|---|---|---|
| JP | 2004-55995 | A | 2/2004 |
| JP | 2008-258510 | A | 10/2008 |
| JP | 2009-26850 | | 2/2009 |
| JP | 2009-59828 | A | 3/2009 |
| JP | 5057892 | | 10/2012 |
| JP | 2013-541827 | | 11/2013 |
| JP | 2015-76449 | A | 4/2015 |
| JP | 2015-519740 | | 7/2015 |

* cited by examiner

| CUMULATIVE TREATED NUMBER | | 19 | 261 | 677 | 1122 |
|---|---|---|---|---|---|
| PEAK TIME(sec) | | 17.9 | 15.4 | 13.9 | 11.4 |
| COMPARATIVE EXAMPLE | THRESHOLD(A) | -98.5 | -98.5 | -98.5 | -98.5 |
| | DETECTION TIME Td(sec) | 17.3 | 14.6 | 13.1 | 10.5 |
| | DETECTION ERROR ΔT(sec) | -0.6 | -0.8 | -0.8 | -0.9 |
| SECOND EMBODIMENT | THRESHOLD(A) | -101.3 | -105.7 | -113.3 | -121.4 |
| | DETECTION TIME(sec) | 17.4 | 14.8 | 13.4 | 11.0 |
| | DETECTION ERROR ΔT(sec) | -0.5 | -0.6 | -0.5 | -0.4 |

| CUMULATIVE TREATED NUMBER | | 19 | 261 | 677 | 1122 |
|---|---|---|---|---|---|
| END POINT TIME(sec) | | 17.4 | 14.8 | 13.4 | 11.0 |
| COMPARATIVE EXAMPLE | MAXIMUM TIME Tmax(sec) | 22.4 | 22.4 | 22.4 | 22.4 |
| | DETECTION ERROR(sec) | 5.0 | 7.6 | 9.0 | 11.4 |
| THIRD EMBODIMENT | DETECTION ERROR Tmax(sec) | 21.9 | 20.6 | 18.3 | 15.9 |
| | DETECTION ERROR(sec) | 4.5 | 5.8 | 4.9 | 4.9 |

| LAST POLISHING TARGET | | DUMMY | GENUINE |
|---|---|---|---|
| PEAK TIME(sec) | | 48.4 | 53.1 |
| COMPARATIVE EXAMPLE | THRESHOLD TH(A) | -15.1 | -15.1 |
| | DETECTION TIME (sec) | 45.5 | 50.5 |
| | DETECTION ERROR (sec) | -2.9 | -2.6 |
| FIFTH EMBODIMENT | THRESHOLD TH(A) | -19.0 | -15.1 |
| | DETECTION TIME (sec) | 47.0 | 50.5 |
| | DETECTION ERROR (sec) | -1.4 | -2.6 |

| THICKNESS OF SILICON OXIDE FILM Tn(nm) | | 721.4 | 670.6 |
|---|---|---|---|
| PEAK TIME(sec) | | 66.8 | 54.3 |
| COMPARATIVE EXAMPLE | THRESHOLD TH(A) | -10.7 | -10.7 |
| | DETECTION TIME (sec) | 62.6 | 50.3 |
| | DETECTION ERROR ΔT(sec) | -4.2 | -4.0 |
| SIXTH EMBODIMENT | THRESHOLD TH(A) | -14.1 | -17.6 |
| | DETECTION TIME (sec) | 65.1 | 53.2 |
| | DETECTION ERROR ΔT(sec) | -1.7 | -1.1 |

| AREA OCCUPANCY RATE (%) | | 30.6 | 52.6 |
|---|---|---|---|
| MINIMUM VALUE DETECTION TIME(sec) | | 20.4 | 19.7 |
| COMPARATIVE EXAMPLE | THRESHOLD CURRENT(A) | 7.89 | 7.89 |
| | DETECTION TIME (sec) | 11.8 | 11.4 |
| | DETECTION ERROR (sec) | -8.6 | -8.3 |
| SEVENTH EMBODIMENT | THRESHOLD CURRENT(A) | 7.01 | 7.45 |
| | DETECTION TIME (sec) | 12.6 | 12.0 |
| | DETECTION ERROR (sec) | -7.8 | -7.7 |

POLISHING DEVICE, POLISHING METHOD, AND RECORD MEDIUM

CROSS-REFERENCE TO RELATED APPLICATIONS

This application is based upon and claims the benefit of priority from Japanese Patent Application No. 2017-151878, filed on Aug. 4, 2017; the entire contents of which are incorporated herein by reference.

FIELD

An embodiment of the present invention relates to a polishing device, a polishing method, and a record medium.

BACKGROUND

In a chemical-mechanical polishing step which is one of steps for manufacturing a semiconductor device, end point detection in which an end point of polishing is detected is performed. In the end point detection, it is common that a polishing time is controlled by detection of a characteristic value correlated with the surface state of a polishing target during polishing. When the characteristic value satisfies an end point condition which is fixed in advance, the polishing is ended.

An appropriate value of the end point condition may vary according to the state of a polishing device, etc. For this reason, in the conventional end point detection with the end point condition fixed in advance, the detection accuracy may be insufficient. As a result, excessive/deficient polishing may be caused.

An embodiment of the present invention provides a polishing device, a polishing method, and a record medium which are capable of enhancing the accuracy of end point detection.

DETAILED DESCRIPTION

Embodiments will now be explained with reference to the accompanying drawings. The present invention is not limited to the embodiments.

First Embodiment

Figure 1:
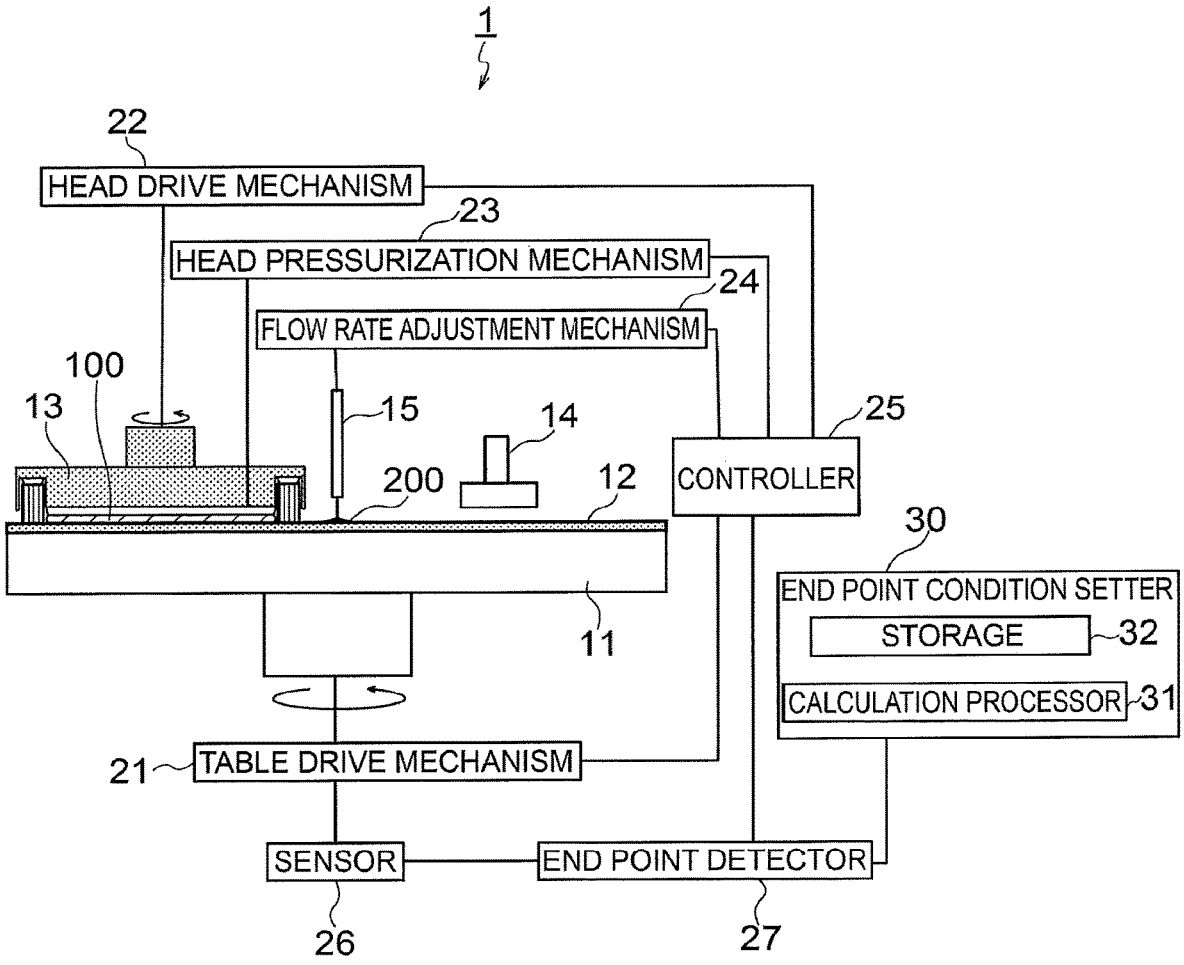
FIG. 1 is a schematic diagram schematically showing the configuration of a polishing device according to a first embodiment.

FIG. 1 is a block diagram showing the configuration of a polishing device according to a first embodiment. In a polishing device 1 shown in FIG. 1, a polishing table 11 is set. The polishing table 11 is connected to a table drive mechanism 21. The table drive mechanism 21 rotates the polishing table 11 at an arbitrarily defined rotation speed. An exchangeable polishing pad 12 is set on the polishing table 11.

A polishing head 13 is set above the polishing pad 12. The polishing head 13 holds a polishing target 100. The polishing head 13 is connected to a head drive mechanism 22.

The head drive mechanism 22 rotates the polishing head at an arbitrarily defined rotation speed. Further, the polishing head 13 is connected to a head pressurization mechanism 23. The polishing target 100 is pressurized with an arbitrarily defined pressure applied by the head pressurization mechanism 23.

In addition, a dresser 14 and a nozzle 15 are set above the polishing pad 12. Grinding particles are fixedly attached to the dresser 14. The grinding particles grind a surface of the polishing pad 12 each time polishing of the polishing target 100 is ended. Accordingly, the surface of the polishing pad 12 is initialized every time of polishing.

The nozzle 15 supplies slurry 200 onto the polishing pad 12. The nozzle 15 is connected to a flow rate adjustment mechanism 24. The flow rate adjustment mechanism 24 adjusts the flow rate of the slurry 200.

The table drive mechanism 21, the head drive mechanism 22, the head pressurization mechanism 23, and the flow rate adjustment mechanism 24 are each connected to a controller 25. The controller 25 controls the rotation speed of the polishing table 11, the rotation speed of the polishing head 13, a pressure to be applied to the polishing target 100, and the flow rate of the slurry 200.

During polishing of the polishing target 100 with the polishing device 1 according to the present embodiment, the head drive mechanism 22 rotates the polishing head 13 while the table drive mechanism 21 rotates the polishing table 11. Here, a sensor 26 senses the drive current of the table drive mechanism 21 and outputs the drive current to an end point detector 27.

When detecting the characteristics indicated by the waveform of the drive current or a maximum polishing time which is set in advance, the end point detector 27 transmits a detection signal to the controller 25. Upon receiving the detection signal, the controller 25 switches an end of polishing or a polishing condition.

Figure 2:
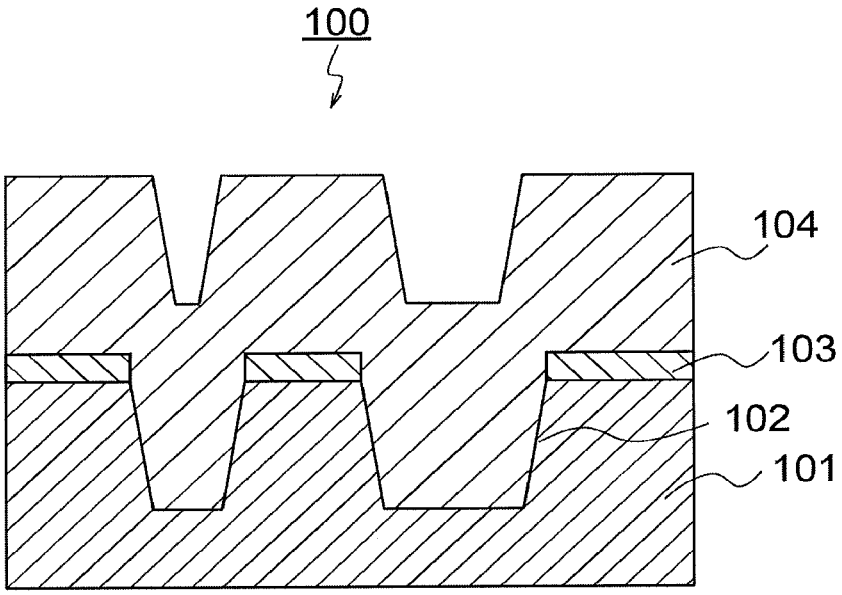
FIG. 2 is a cross-sectional view showing the structure of a polishing target.

FIG. 2 is a cross-sectional view showing the structure of the polishing target 100. In the polishing target 100 shown in FIG. 2, a groove 102 is formed in a substrate 101. Also, a stopper film 103 is formed on the substrate 101. In addition, a polishing target film 104 is embedded in the groove 102, and is formed on the stopper film 103.

Figure 3:
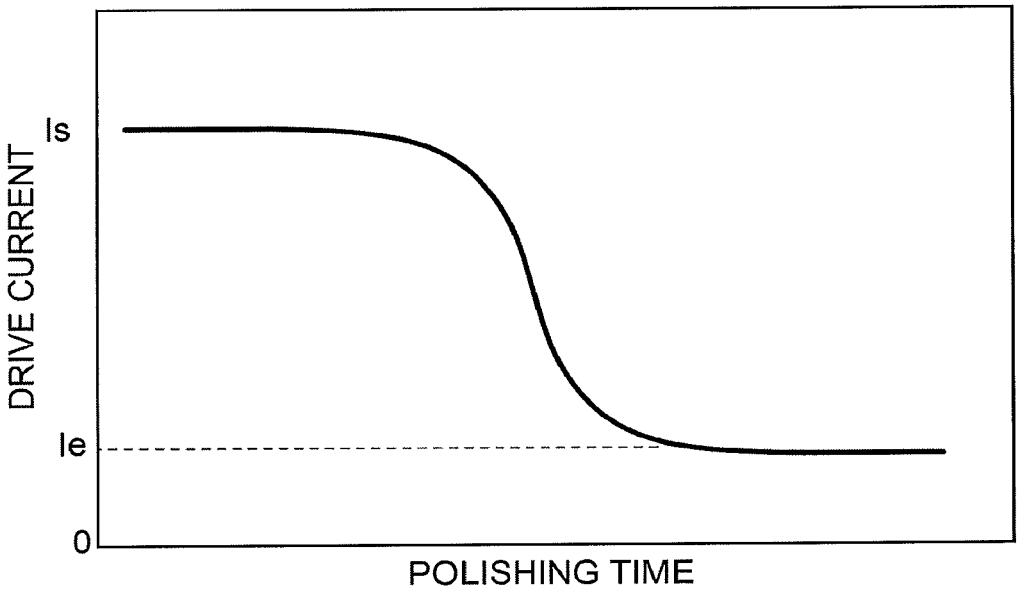
FIG. 3 is a diagram showing the waveform of drive current of a table drive mechanism.

FIG. 3 is a diagram showing the waveform of the drive current of the table drive mechanism 21. The drive current varies according to a friction force generated between a surface of the polishing target 100 and the surface of the polishing pad 12. When the friction force becomes large, the drive current also becomes large. On the other hand, when the friction force becomes small, the drive current also becomes small.

For example, in a case where the polishing pad 12 polishes the polishing target film 104 of the polishing target 100, the drive current starts to decrease from an initial polishing current value Is after exposure of a part of the stopper film 103 is started. Subsequently, when the entire stopper film 103 is exposed, the drive current converges on the terminal polishing current value Ie. In the present embodiment, in order to accurately detect change in the drive current, the end point detector 27 differentiates the drive current and detects the characteristics on the basis of change in the differential value.

Figure 4:
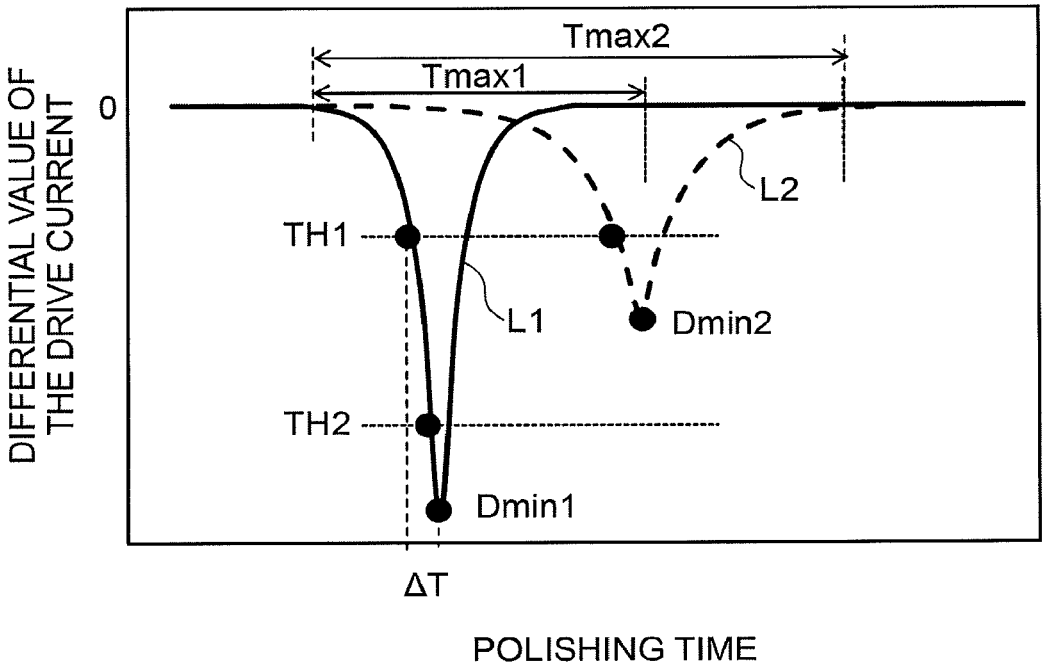
FIG. 4 is a diagram showing the waveform obtained by differentiating the drive current of the table drive mechanism.

FIG. 4 is a diagram showing a waveform obtained by differentiating the drive current of the table drive mechanism 21. A solid line L1 shown in FIG. 4 indicates a waveform obtained by differentiating the drive current shown in FIG. 3. When a time period from the start of exposure of the stopper film 103 to completion thereof, that is, the polishing time is short, the differentiation waveform of the drive current becomes sharp as indicated by the solid line L1, and thereby, reaches a local minimum value Dmin1 at an earlier time.

However, there is a possibility that the polishing time varies according to the state of the polishing device 1 or the state of the polishing target 100. For example, when the polishing time is long, the differentiation waveform of the drive current becomes moderate as indicated by a broken line L2, and thereby, reaches a local minimum value Dmin2 at a later time.

It is assumed that a threshold value TH1 is fixed as the end point condition of polishing such that the end point detector 27 detects the end points of the two polishing forms indicated by the solid line L1 and the broken line L2. On this assumption, the detection error ΔT between a time at which the threshold TH1 is detected and a time at which the local minimum value Dmin1 is detected becomes large in the polishing form indicated by the solid line L1. Moreover, there is a possibility that the threshold TH1 is erroneously detected due to noise in the current waveform.

In addition, the maximum time for determining the time of the polishing step when the end point detection based on the threshold has failed is set to Tmax1, whereby excessive polishing at the failure of end point detection can be inhibited in the polishing form indicated by the solid line L1. However, in the polishing form indicated by the broken line L2, the polishing step is ended before the local minimum value of the differentiation waveform is reached. This may result in deficient polishing. On the other hand, when the maximum time is set to Tmax2 (>Tmax1), excessive polishing due to the failure of end point detection cannot be inhibited in the polishing form indicated by the solid line L1, and thus, poor polishing is highly likely caused.

Therefore, the polishing device 1 according to the present embodiment includes an end point condition setter 30 which optimizes the end point condition, as illustrated in FIG. 1. The end point condition setter 30 may have a configuration separated from the polishing device 1, or may have a configuration integrated with the end point detector 27.

The end point condition setter 30 includes a calculation processor 31 and storage 32. For example, the calculation processor 31 is formed of a CPU (central processing unit) which operates in accordance with a predetermined program. For example, the storage 32 is formed of a semiconductor memory having the program, etc. stored therein.

At least device information about the polishing device 1 or polishing target information about the polishing target 100 is inputted to the calculation processor 31. Such information may be temporarily stored in the storage 32, or may be inputted to the end point condition setter 30 over a network channel.

The device information corresponds to the use state of the polishing pad 12, the use state of the dresser 14, the grinding rate (the grinding amount per unit time) of the polishing pad 12, and the like. The use states of the polishing pad 12 and the dresser 14 include the cumulative number of treated targets, an accumulated treatment time, an abrasion amount, and a torque value at the time of dressing, for example. The device information also corresponds to a value detected so far by the end point detector 27, the history of polishing targets polished so far by the polishing pad 12, and the like.

The polishing target information corresponds to the film thickness, a surface step, the warp amount, or the like of a polishing target. The polishing target information also corresponds to the length of a pattern formed on a surface of a polishing target, and the occupancy rate of the plane area of a pattern with respect to the entire surface. Moreover, the polishing target information also corresponds to information about a treatment step already performed on a polishing target, such as information about a treatment device, a treatment history, and shape measurement.

The calculation processor 31 sets the end point condition in accordance with at least the aforementioned device information or the aforementioned polishing target information. In the present embodiment, the calculation processor 31 sets, as the end point condition, the threshold of the differentiated current of the table drive mechanism 21 and the maximum time of polishing.

Figure 5:
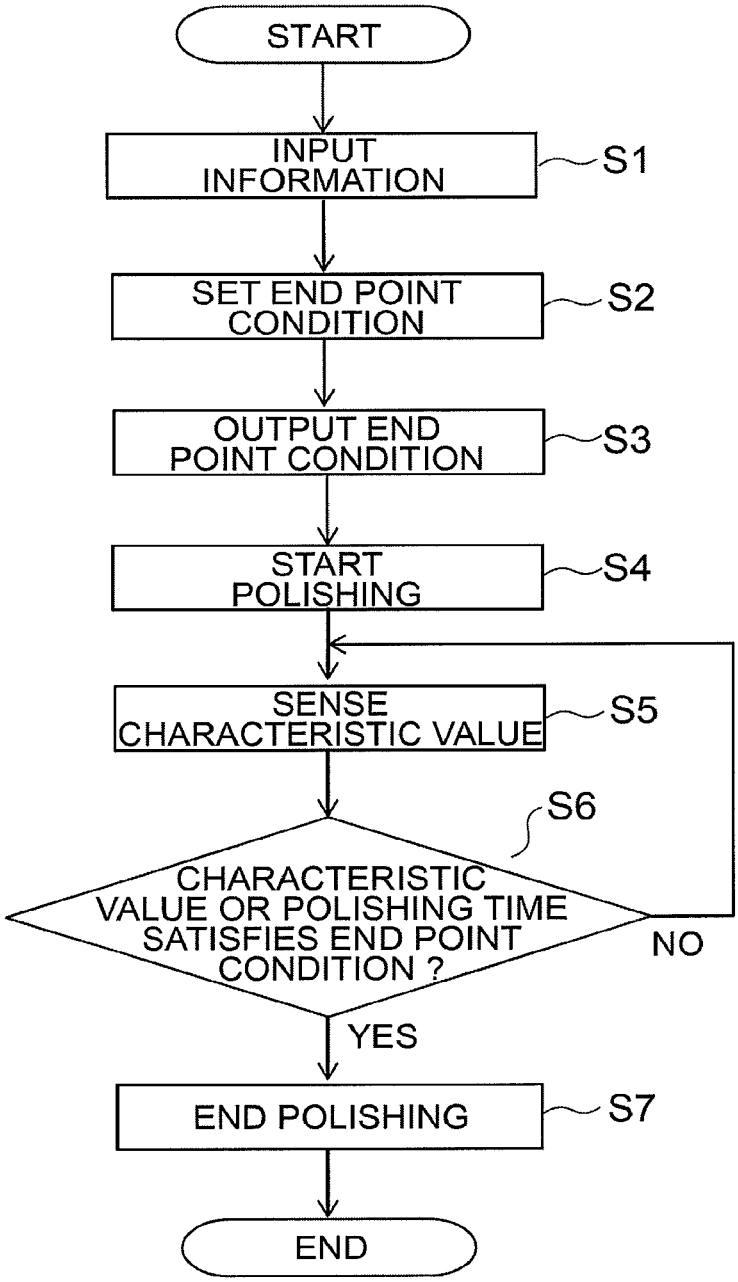
FIG. 5 is a flowchart showing procedures of a polishing operation.

Hereinafter, a polishing method using the aforementioned polishing device 1 is described with reference to FIG. 5. FIG. 5 is a flowchart showing the procedures of a polishing operation.

First, at least the device information or the polishing target information is inputted to the end point condition setter 30 (step S1).

Next, the calculation processor 31 sets the end point condition of polishing in accordance with the inputted information (step S2). At step S2, for example, the calculation processor 31 sets the threshold TH2 and the maximum time Tmax1 for the polishing form indicated by the solid line L1, and sets the threshold TH1 and the maximum time Tmax2 for the polishing form indicated by the broken line L2.

The end point condition may include not only the threshold and the maximum time but also an elapsed time from detection of the threshold, an average section for smoothing a current waveform including noise, a section for calculating the gradient of a current waveform, the average section of the gradient, etc. The calculation processor 31 can also select, according to the inputted information, a condition to be applied from among different end point conditions as described above.

After setting the end point condition in the aforementioned manner, the calculation processor 31 outputs the set end point condition to the end point detector 27 (step S3). As a result, the end point condition to be detected by the end point detector 27 is changed. For example, the end point detector 27 is to be able to set a plurality of thresholds in advance, and one of the plurality of thresholds is set as the end point condition by the calculation processor 31.

Next, polishing of the polishing target 100 is started (step S4). Specifically, the controller 25 controls the table drive mechanism 21, the head drive mechanism 22, and the flow rate adjustment mechanism 24, so that the polishing table 11 and the polishing head 13 are rotated and the slurry 200 is supplied from the nozzle 15. Accordingly, the polishing target film 104 of the polishing target 100 is polished with the polishing pad 12.

When the polishing is started, the sensor 26 senses a characteristic value correlated with the surface state of the polishing target 100 (step S5). In the present embodiment, the sensor 26 senses the drive current of the table drive mechanism 21 as the characteristic value. The sensor 26 outputs the sensed drive current to the end point detector 27.

In addition to the drive current, what to be sensed by the sensor 26 may be the drive current of the head drive mechanism 22, the surface temperature or the polishing sound of the polishing pad 12, the vibration frequency of the polishing table 11 or polishing head 13, the amount of gas generated by a chemical reaction between the polishing target and the slurry 200, etc.

Next, the end point detector 27 detects whether or not the characteristic value or the polishing time satisfies the end point condition (step S6). Specifically, the end point detector 27 obtains the differential value of the drive current inputted from the sensor 26. Subsequently, the end point detector 27 determines whether or not the differential value is lower than the threshold set by the calculation processor 31. When the differential value is less than the threshold, the end point detector 27 determines that the end point condition is satisfied, and transmits a detection signal to the controller 25. When the polishing time is longer than the maximum time set by the calculation processor 31, the end point detector 27 also determines that the end point condition is satisfied, and transmits a detection signal to the controller 25. Upon receiving the detection signal, the controller 25 ends polishing (step S7).

According to the aforementioned present embodiment, information to have an influence on the end point detection is inputted to the end point condition setter 30. The end point condition setter 30 appropriately sets the end point condition in accordance with the inputted information. The end point detector 27 detects the end point of polishing on the basis of the end point condition optimized by the end point condition setter 30. Consequently, the accuracy of end point detection can be enhanced.

Second Embodiment

The configuration of a polishing device according to a second embodiment is the same as that of the polishing device 1 according to the first embodiment. Therefore, a detailed explanation thereof is omitted.

Figure 6A:
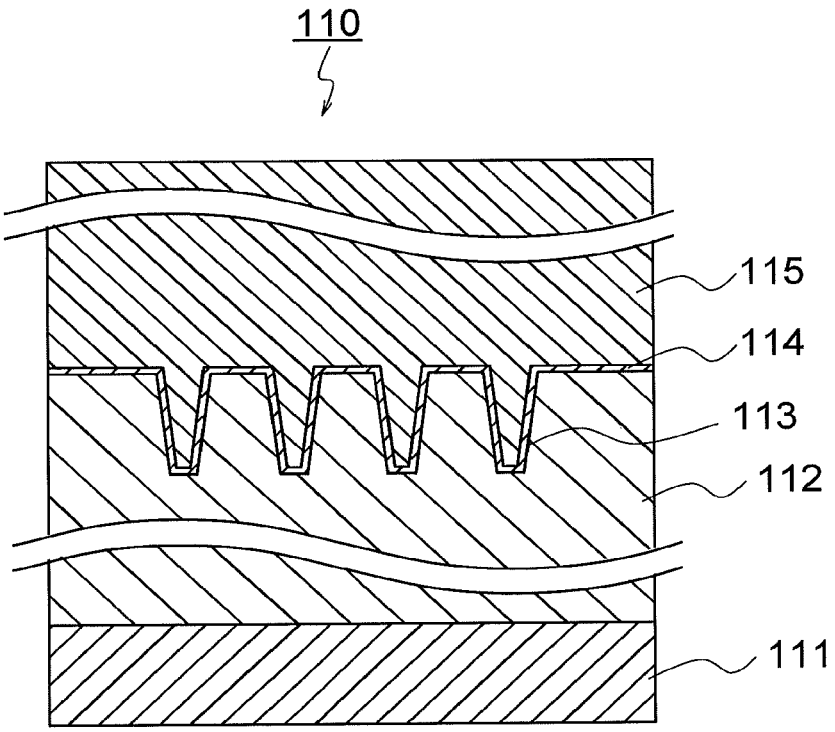
FIG. 6A is a cross-sectional view showing the structure of a polishing target before polishing.
Figure 6B:
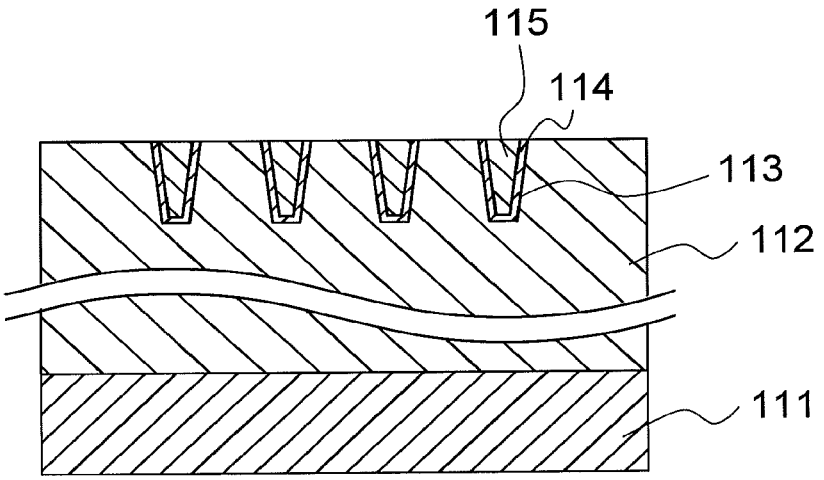
FIG. 6B is a cross-sectional view showing the structure of the polishing target after polishing.

FIG. 6A is a cross-sectional view showing the structure of a polishing target before polishing according to the present embodiment. FIG. 6B is a cross-sectional view showing the structure of the polishing target after polishing.

In a polishing target 110 shown in FIG. 6A, a silicon oxide film 112 is formed on a silicon substrate 111. A groove 113 is formed in the upper surface of the silicon oxide film 112. A barrier metal layer 114 using titanium (Ti), for example, is formed on the upper surface of the silicon oxide film 112 and on the inner surface of the groove 113. A wiring layer 115 using copper (Cu), for example, is formed on the barrier metal layer 114.

In the present embodiment, the barrier metal layer 114 and the wiring layer 115 formed on the silicon oxide film 112 are polished with the slurry 200 containing silica abrasive grains. As a result, a structure in which the barrier metal layer 114 and the wiring layer 115 are embedded in the groove 113, or a so-called damascene wiring structure is formed, as shown in FIG. 6B.

Figures 7, 8:
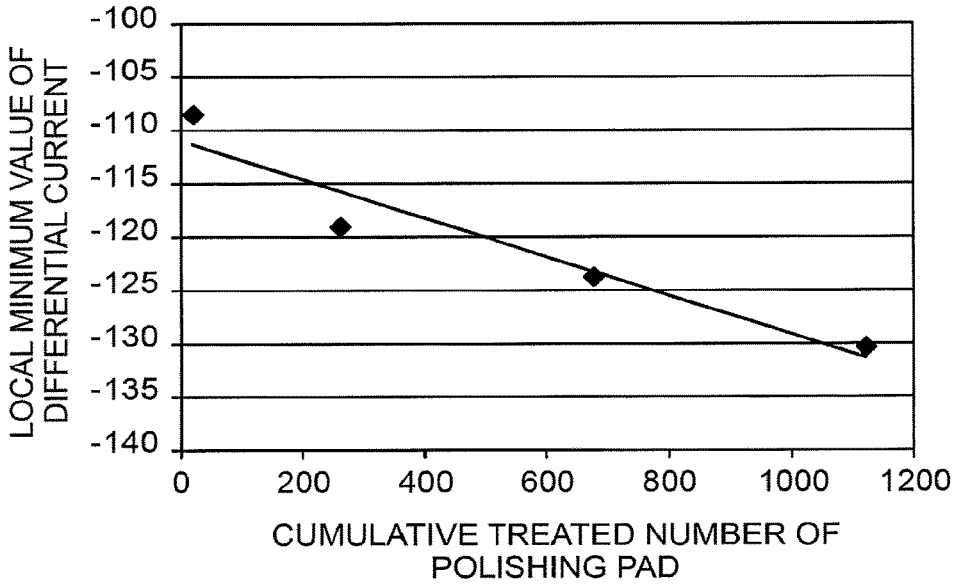
FIG. 7 is a diagram showing the relationship between the cumulative number of targets treated by a polishing pad and the local minimum value of differentiated current.
FIG. 8 is a table showing measurement results of detection errors in a comparative example and a second embodiment.

FIG. 7 is a diagram showing the relationship between the cumulative treated number of the polishing pad 12 and the local minimum value of the differentiated current. The differentiated current is obtained by differentiating the drive current of the table drive mechanism 21. According to FIG. 7, with the increase in the cumulative number of treated targets, the local minimum value of the differentiated current becomes smaller. Thus, there is a correlation between the cumulative number and the local minimum value.

Therefore, in the present embodiment, the cumulative treated number of the polishing pad 12 is inputted as the device information to the end point condition setter 30 at step S1, and the calculation processor 31 sets, as a function of the cumulative number Cpad of treated targets, the threshold TH of the differentiated current of the table drive mechanism 21 at step S2. According to FIG. 7, the cumulative number of treated targets and the local minimum value are substantially in a linear relationship. Thus, the calculation processor 31 sets the threshold TH as the end point condition on the basis of the following expression (1).

$$TH=-0.0182\times Cpad-110.95+10 \quad (1)$$

The expression (1) is an approximate expression of the straight line shown in FIG. 7, with 10 (A/min) as a variation margin taken into consideration.

FIG. 8 is a table showing measurement results of the detection errors ΔT in a comparative example and the present embodiment. The detection error ΔT is the time difference between the detection time of the threshold TH and the peak time at which the local minimum value is detected.

As shown in FIG. 8, with the increase in the cumulative treated number of the polishing pad 12, the peak time becomes shorter. However, in the comparative example, the detection error ΔT becomes larger with the increase in the cumulative number of treated targets, because the threshold TH is fixed.

In contrast, in the present embodiment, the threshold TH is changed according to the cumulative number of target treated by the polishing pad 12 on the basis of the above expression (1). Consequently, the detection error ΔT is small even with the increase in the cumulative number of treated targets.

According to the aforementioned present embodiment, the calculation processor 31 optimizes the threshold TH of the differentiated current as one kind of the end point condition, on the basis of the cumulative treated number of the polishing pad 12 as one kind of the device information. Accordingly, a detection error of the end point detector 27 becomes small so that excessive/deficient polishing can be avoided.

The device information may be, other than the cumulative treated number of the polishing pad 12, information indicating the state of a consumable member such as the cumulative time of treatment performed by the polishing pad 12, the cumulative number of targets treated by the dresser 14, the cumulative time of treatment performed by the dresser 14, the cumulative time of dressing performed by the polishing pad 12, or the wear amount of the polishing pad 12.

The end point detector 27 may further detect change of the drive current value or change of a secondary differential value of the drive current, other than the change of the differential value of the drive current. In addition, the end point detector 27 may set, instead of the threshold, a detection condition of detecting a decrease start point or an increase start point of the waveform of the characteristic value in accordance with the device information. Moreover, the calculation processor 31 may calculate the detection condition by using a high order expression or a polynomial expression using multiple kinds of information, instead of the above expression (1), in order to further enhance the accuracy.

Third Embodiment

The configuration of a polishing device according to a third embodiment is the same as that of the polishing device 1 according to the first embodiment. Also, a polishing target according to the present embodiment is the same as the polishing target 110 according to the second embodiment. Therefore, detailed explanations thereof are omitted.

Figures 9, 10:
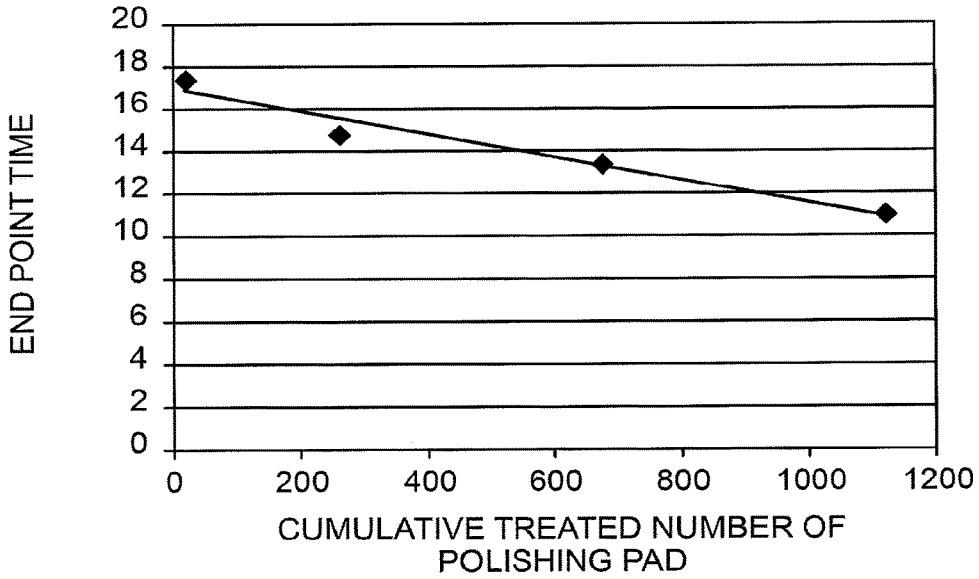
FIG. 9 is a diagram showing the relationship between the cumulative number of targets treated by the polishing pad and a time to the end point of polishing.
FIG. 10 is a table showing measurement results of detection errors in a comparative example and a third embodiment.

FIG. 9 is a diagram showing the relationship between the cumulative treated number of the polishing pad 12 and a time to the end point of polishing. According to FIG. 9, with the increase in the cumulative number of treated targets became greater, the time to the end point becomes shorter. Thus, there is a correlation between the cumulative number and the time to the end point.

Therefore, in the present embodiment, the cumulative treated number of the polishing pad 12 is inputted as the device information to the end point condition setter 30 at step S1, and the calculation processor 31 sets, as a function of the cumulative number Cpad of treated targets, the maximum time Tmax of the polishing time at step S2. According to FIG. 9, the cumulative number of treated targets and the time to the end point are substantially in a linear relationship. Thus, the calculation processor 31 sets the maximum time Tmax as the end point condition on the basis of the following expression (2).

$$Tmax=-0.0054\times Cpad+16.96+5 \quad (2)$$

The expression (2) is an approximate expression of the straight line shown in FIG. 9 with 5 (sec) as a variation margin taken into consideration.

FIG. 10 is a table showing measurement results of detection errors in a comparative example and the present embodiment. The detection error is the time difference between the time to the end point of polishing and the maximum time Tmax of polishing.

As shown in FIG. 10, with the increase in the cumulative treated number of the polishing pad 12, the time to the end point becomes shorter. However, in the comparative example, a detection error caused when the end point detection fails becomes larger with the increase in the cumulative number of treated targets, because the maximum time Tmax is fixed.

In contrast, in the present embodiment, the maximum time Tmax is changed according to the cumulative treated number of the polishing pad 12 on the basis of the above expression (2). Consequently, a detection error caused when the end point detection fails is small even with the increase in the cumulative number of treated targets.

According to the aforementioned present embodiment, the calculation processor 31 optimizes the maximum time Tmax of the polishing time as one kind of the end point condition, according to the cumulative treated number of the polishing pad 12 as one kind of the device information. Accordingly, a detection error caused when the end point detector 27 fails to detect the end point is small so that excessive polishing can be inhibited and poor polishing can be inhibited. The device information may be information indicating the state of a consumable member, other than the cumulative treated number of the polishing pad 12, as in the second embodiment.

In order to make the detection error smaller, enhancement of the accuracy of predicting the time to the end point is desirable. Therefore, the calculation processor 31 may predict the time to the end point on the basis of the polishing rate acquired in inspection of the device, and set the maximum time Tmax according to the predicted time to the end point. Also, the calculation processor 31 may set the maximum time Tmax on the basis of the time to the end point of the last treated polishing target 110.

Fourth Embodiment

The configuration of a polishing device according to a fourth embodiment is the same as that of the polishing device 1 according to the first embodiment. Also, a polishing target according to the present embodiment is the same as the polishing target 110 according to the second embodiment. Therefore, detailed explanations thereof are omitted.

According to FIG. 7 described in the second embodiment, with the increase in the cumulative treated number of the polishing pad 12, the local minimum value of the differentiated current which is obtained by differentiating the drive current of the table drive mechanism 21 becomes smaller.

Therefore, in the present embodiment, the local minimum value Dmin of the differentiated current detected in the last polishing by the end point detector 27 is inputted as the device information to the end point condition setter 30. In the end point condition setter 30, the calculation processor 31 sets a threshold THnext of polishing of a next polishing target 110 on the basis of the following expression (3) at step S2.

$$THnext=Dmin+10 \quad (3)$$

For example, when the last local minimum value Dmin is −108.5, the threshold THnext is −98.5(=−108.5+10) on the basis of the above expression (3).

According to the aforementioned present embodiment, even when the local minimum value of the differentiated current corresponding to the end point of polishing varies according to the cumulative treated number of the polishing pad 12, the calculation processor 31 sets the threshold corresponding to the variation. Consequently, the detection error of the end point detector 27 becomes small so that excessive/deficient polishing can be avoided.

In the present embodiment, the aforementioned threshold is set on the basis of the last detected characteristic value of the polishing target 110. Accordingly, the present embodiment is particularly efficient for a case where controlling of the threshold based on the expression (1) described in the second embodiment is difficult due to complicated long-term variation in data of the end point detection.

Note that the characteristic value of a dummy polishing target which is regularly or irregularly polished may be used in the present embodiment. Further, instead of one last detected characteristic value, the average value of multiple characteristic values detected so far may be used. In this case, an influence of sudden variation can be reduced.

Fifth Embodiment

The configuration of a polishing device according to a fifth embodiment is the same as that of the polishing device 1 according to the first embodiment. Therefore, a detailed explanation of the polishing device is omitted.

Figure 11A:
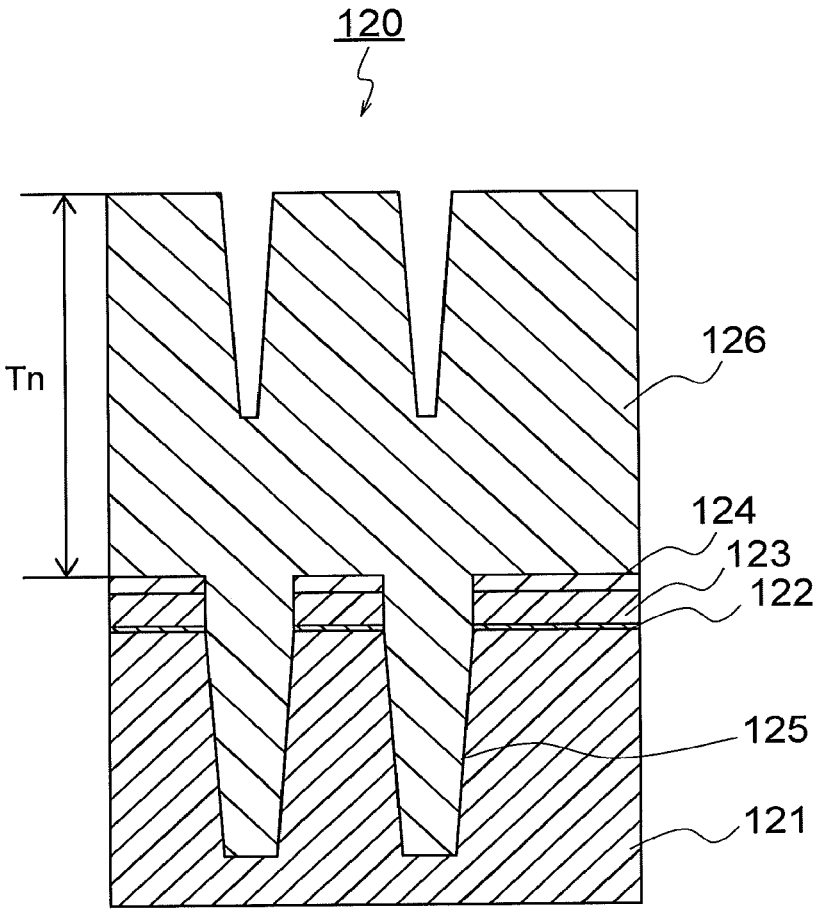
FIG. 11A is a cross-sectional view showing the structure of another polishing target before polishing.
Figure 11B:
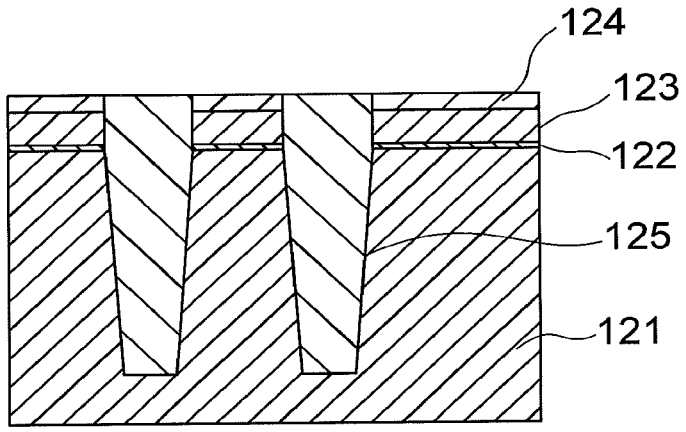
FIG. 11B is a cross-sectional view showing the structure of the another polishing target after polishing.

FIG. 11A is a cross-sectional view showing the structure of a polishing target before polishing according to the present embodiment. FIG. 11B is a cross-sectional view showing the polishing target after polishing.

In a polishing target 120 shown in FIG. 11A, a gate insulation film 122 is formed on a silicon substrate 121. A polysilicon film 123 is formed on the gate insulation film 122. A silicon nitride film 124 is formed on the polysilicon film 123. These films are separated from each other by a trench 125 extending to the inside of the silicon substrate 121. The silicon oxide film 126 is embedded in the trench 125.

In the present embodiment, the silicon oxide film 126 is polished with use of the slurry 200 containing ceria abrasive grains until the silicon nitride film 124 is exposed. As a result, an element isolation structure is formed as shown in FIG. 11B.

In the polishing device 1, the surface state of the polishing pad 12 may change when the polishing treatment interval thereof is long. Thus, when polishing treatment is resumed, the surface state of the polishing pad 12 is adjusted first by polishing of a dummy polishing target. However, even by such polishing, the surface state of the polishing pad 12 is difficult to completely adjust.

Figures 12, 13:
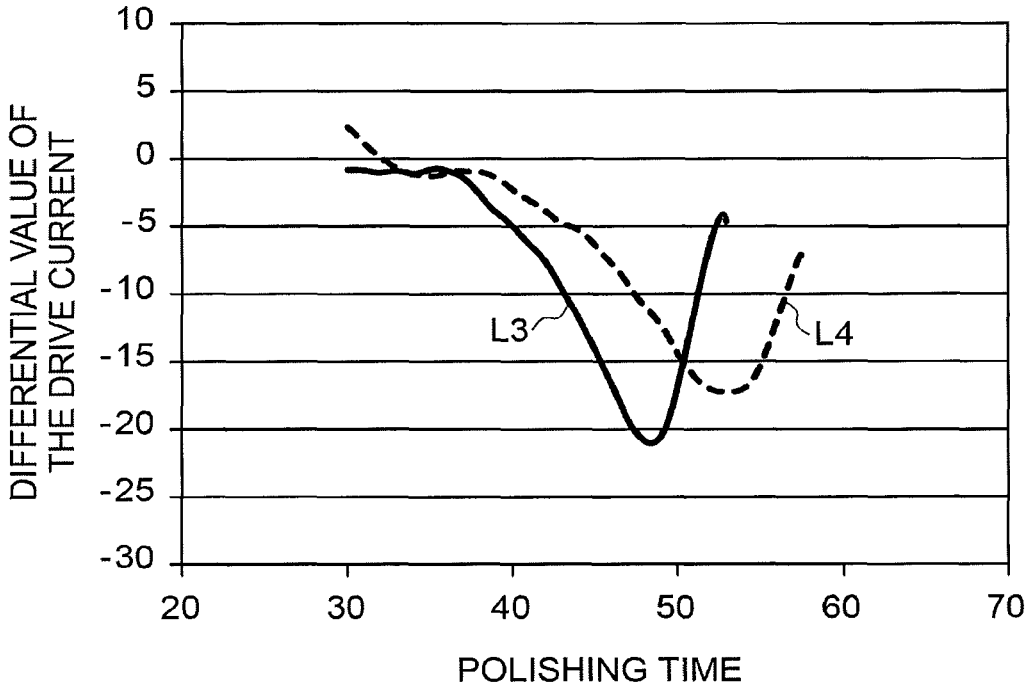
FIG. 12 is a diagram showing waveforms obtained by differentiating the drive current of the table drive mechanism in a case where the polishing targets are polished under different polishing conditions.
FIG. 13 is a table showing measurement results of detection errors $\Delta T$ in a comparative example and a fifth embodiment.

FIG. 12 is a diagram showing the waveforms obtained by differentiating the drive current of the table drive mechanism 21 in a case where polishing targets are polished under different polishing conditions. A solid line L3 shown in FIG. 12 indicates the waveform of the differentiated current when the polishing target 120 is polished immediately after a dummy polishing target is polished. A broken line L4 indicates the waveform of the differentiated current when the polishing targets 120 are continuously polished.

According to FIG. 12, the local minimum value when the polishing target 120 is polished immediately after polishing of a dummy polishing target, is less than the local minimum value when the polishing targets 120 are continuously polished. Also, the peak time in which the local minimum value is detected is shorter.

Therefore, in the present embodiment, history information indicating the history of a polishing target last polished by the polishing device 1 is inputted as the device information to the end point condition setter 30 at step S1. In the end point condition setter 30, the calculation processor 31 sets the threshold TH of the differentiated current of the table drive mechanism 21 in accordance with the history information at step S2.

FIG. 13 is a table showing measurement results of the detection errors ΔT in a comparative example and the present embodiment. The detection error ΔT is the time difference between the detection time of the threshold TH and the peak time at which the local minimum value is detected.

When the last polishing target is a dummy, the peak time becomes short, as described above. However, the threshold TH is fixed in the comparative example. Consequently, the detection error ΔT is large immediately after polishing of a dummy polishing target.

In contrast, in the present embodiment, when the last polishing target is a dummy, the calculation processor 31 changes the threshold TH. Consequently, the detection error ΔT is small even immediately after polishing of a dummy polishing target.

According to the aforementioned present embodiment, the calculation processor 31 optimizes the threshold value VTH of the differentiated current as one kind of the end point condition, in accordance with the history information as one kind of the device information. Accordingly, the detection accuracy of the end point detector 27 can be maintained even when a genuine polishing target is polished immediately after polishing of a dummy polishing target.

The history information in the present embodiment indicates whether or not the last polished polishing target is dummy, but is not limited thereto. For example, when treatment of multiple kinds of polishing targets or multiple treatment steps are performed by the same device, the surface state of the polishing pad 12 changes depending on the type of the last treated polishing target or the last treatment step. Therefore, the history information may include the type of a polishing target treated last and a treatment step performed last.

Sixth Embodiment

The configuration of a polishing device according to a sixth embodiment is the same as that of the polishing device 1 according to the first embodiment. Also, a polishing target according to the present embodiment is the same as the polishing target 120 according to the fifth embodiment. Therefore, detailed explanations thereof are omitted.

Figures 14, 15:
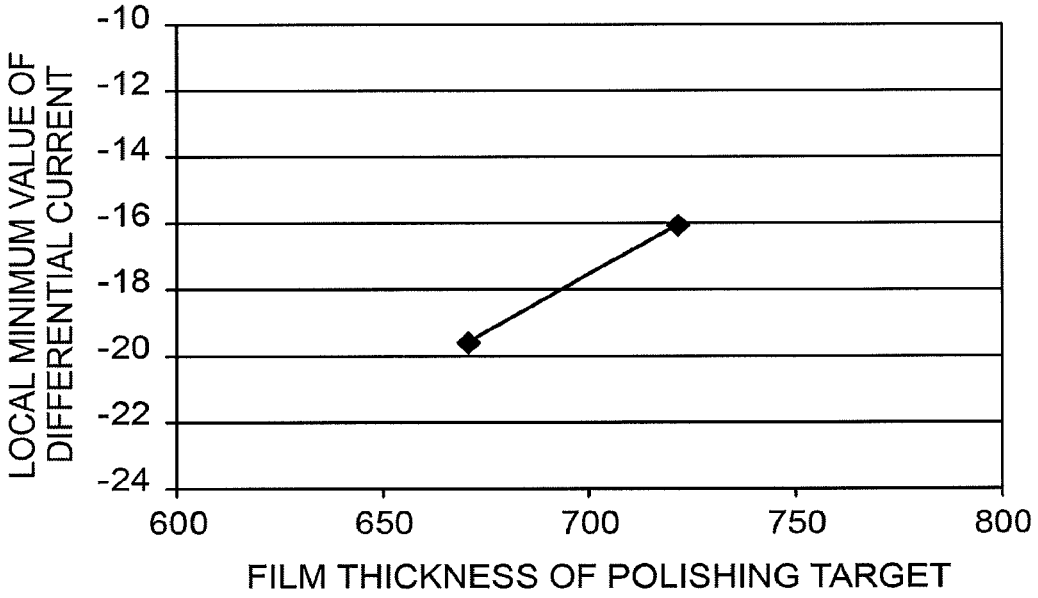
FIG. 14 is a diagram showing the relationship between the film thickness of the polishing target and the local minimum value of the differentiated current.
FIG. 15 is a table showing measurement results of detection errors in a comparative example and a sixth embodiment.

FIG. 14 is a diagram showing the relationship between the film thickness of a polishing target and the local minimum value of the differentiated current. The film thickness of a polishing target corresponds to a film thickness Tn of the silicon oxide film 126 shown in FIG. 11A. The differentiated current is obtained by differentiating the drive current of the table drive mechanism 21. According to FIG. 14, with the increase in the film thickness Tn, the local minimum value becomes greater. Thus, there is a correlation between the film thickness and the local minimum value.

Therefore, in the present embodiment, the film thickness of the silicon oxide film 126 is inputted as the polishing target information to the end point condition setter 30 at step S1. In the end point condition setter 30, the calculation processor 31 sets, at step S2, the threshold TH of the differentiated current of the table drive mechanism 21 by using the following expression (4).

$$TH=0.0694\times Tn-66.17+2 \quad (4)$$

In the expression (4), 2 (A/min) is taken as a variation margin into consideration.

FIG. 15 is a table showing measurement results of the detection errors ΔT in a comparative example and the present embodiment. The detection error ΔT is the time difference between the detection time of the threshold TH and the peak time at which the local minimum value is detected.

As shown in FIG. 15, the peak time varies according to the film thickness Tn of a polishing target. However, in the comparative example, the detection error ΔT is large because the threshold TH is fixed. In contrast, in the present embodiment, the threshold TH is changed according to the film thickness Tn of a polishing target. Thus, the detection error ΔT is smaller than that in the comparative example.

According to the aforementioned present embodiment, the calculation processor 31 optimizes the threshold TH of the differentiated current as one kind of the end point condition in accordance with the film thickness of the polishing target as one kind of the polishing target information. Consequently, a detection error of the end point detector 27 becomes small so that excessive/deficient polishing can be avoided.

A film thickness measurement device for measuring the film thickness Tn may be provided to the polishing device 1, or may be provided independently of the polishing device 1. The film thickness Tn may be not directly by the film thickness measurement device, but indirectly obtained. For example, the film thickness Tn has a correlation with the physical quantity such as a treatment time, the pressure, the temperature, or the gas flow rate of a film formation device. In this case, when such a physical quantity is inputted as the polishing target information, the calculation processor 31 converts the inputted physical quantity to the film thickness Tn.

Alternatively, the polishing target information may include a surface step, a warp amount, the length of a pattern, etc., other than the film thickness Tn. In this case, the calculation processor 31 may set the threshold TH by combining the information by use of a polynomial expression, etc.

The surface step is correlated with a physical quantity such as the treatment time, the pressure, the temperature, the gas flow rate, or the plasma emission wavelength/intensity of a dry etching device. Thus, measurement information measured at a step prior to the polishing step may be inputted as the polishing target information to the end point condition setter 30. In particular, when the surface step is correlated with the cumulative number of targets treated by a member or the cumulative number of treated targets after chamber cleaning at a prior step, the treatment history information may be used as the polishing target information. When the difference of treatment at the prior step is large between devices or chambers, identification information of the devices and the chambers may be used as the polishing target information.

Seventh Embodiment

The configuration of a polishing device according to a seventh embodiment is the same as that of the polishing device 1 according to the first embodiment. Also, a polishing target according to the present embodiment is the same as the polishing target 110 according to the second embodiment. Therefore, detailed explanations thereof are omitted.

Figures 16, 17:
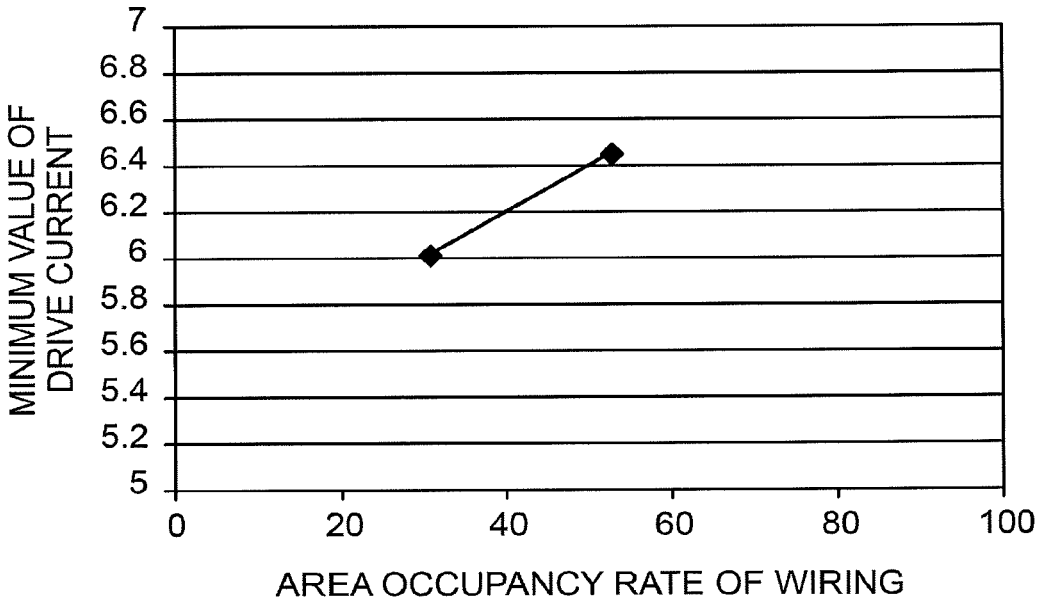
FIG. 16 is a diagram showing the relationship between the area occupancy rate of wiring on the polishing target and the minimum value of the drive current of the table drive mechanism.
FIG. 17 is a table showing measurement results of detection errors in a comparative example and a seventh embodiment.

FIG. 16 is a diagram showing the relationship between the area occupancy rate of wiring on a polishing target and the minimum value of the drive current of the table drive mechanism 21. The area occupancy rate is a rate of the plane area of the wiring layer 115 occupying the plane area (the area of the upper surface) of the polishing target 110 shown in FIG. 6B. According to FIG. 16, the minimum value of the drive current becomes greater with the increase in the area occupancy rate. Thus, there is a correlation between the local minimum value and the area occupancy rate.

Therefore, in the present embodiment, the area occupancy rate is inputted as the polishing target information to the end point condition setter 30 at step S1. In the end point condition setter 30, the calculation processor 31 sets, as a function of the area occupancy rate DN (%) of the wiring layer 115, a threshold current Imin which is regarded as the minimum value of the drive current of the table drive mechanism 21, at step S2. According to FIG. 16, the minimum value of the drive current and the area occupancy rate are substantially in a linear relationship. Thus, the calculation processor 31 sets the threshold current Imin as the end point condition on the basis of the following expression (5).

$$Imin=0.0199\times DN+5.40+1 \quad (5)$$

The expression (5) is an approximate expression of the straight line shown in FIG. 16 with 1 A as a variation margin taken into consideration.

FIG. 17 is a table showing measurement results of the detection errors in a comparative example and the present embodiment. The detection error is the time difference between the detection time of the threshold current Imin and the minimum value detection time at which the minimum value of the drive current is detected.

As shown in FIG. 17, as the minimum value detection time changes according to the area occupancy rate DN of the wiring layer 115. However, in the comparative example, the detection error is large because the threshold current is fixed. In contrast, in the present embodiment, the threshold current is changed according to the area occupancy rate DN. Consequently, the detection error is smaller than that in the comparative example.

According to the aforementioned present embodiment, the calculation processor 31 optimizes the threshold current of the drive current of the table drive mechanism 21 as one kind of the end point condition, in accordance with the area occupancy rate of the wiring layer 115 as one kind of the polishing target information. Consequently, a detection error of the end point detector 27 becomes small so that excessive/deficient polishing can be avoided.

In the present embodiment, the polishing target information is not limited to the area occupancy rate of the wiring layer 115. For example, the polishing target information may be information about a design layout on the surface of the polishing target, including the area rate of a layout pattern which is exposed during polishing of a polishing target and the length of the circumference of the layout pattern.

Eighth Embodiment

Figure 18:
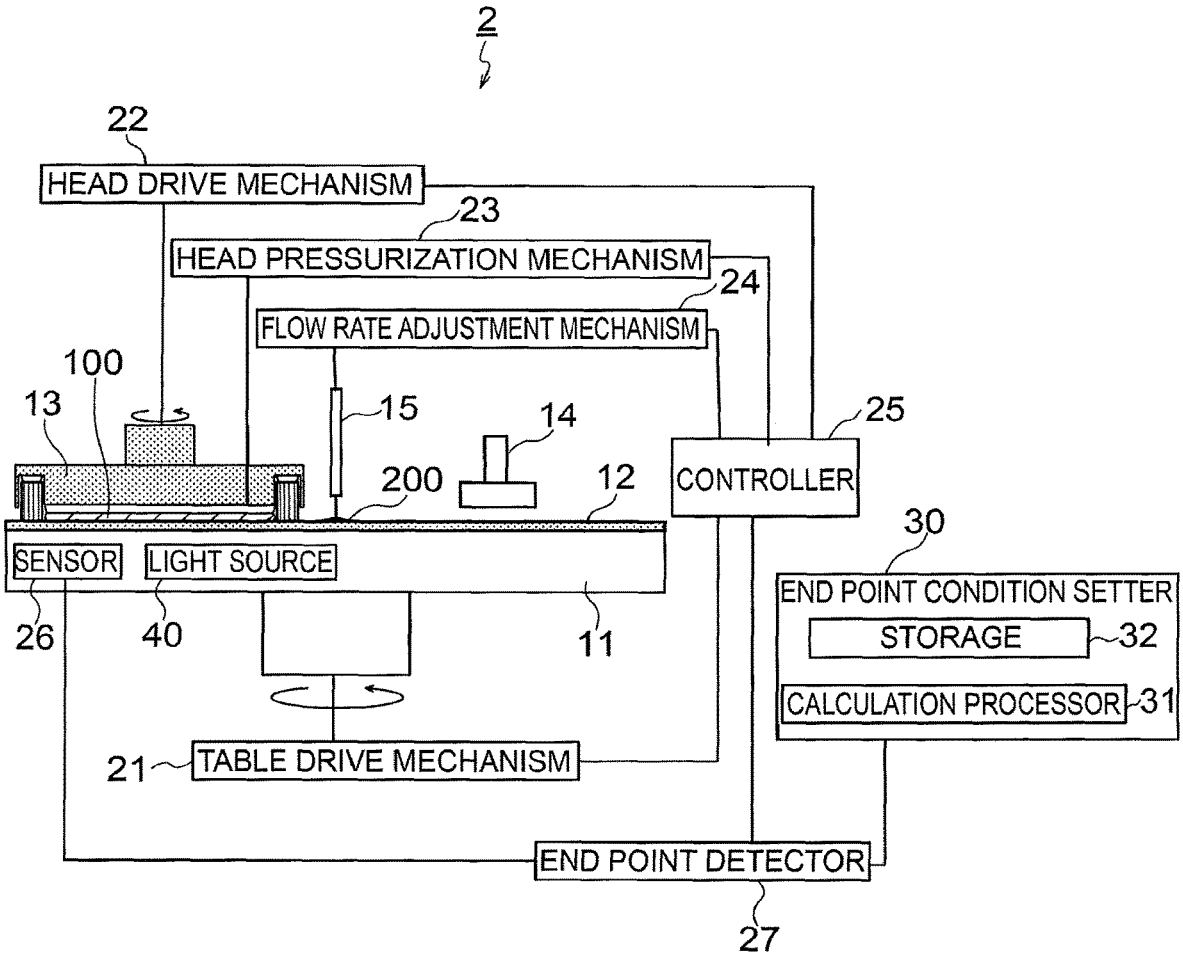
FIG. 18 is a block diagram showing the configuration of a polishing device according to an eighth embodiment.

FIG. 18 is a block diagram showing the configuration of a polishing device according to an eighth embodiment. In a polishing device 2 shown in FIG. 18, components identical to those of the polishing device 1 shown in FIG. 1 are denoted by the same reference numerals and detailed explanations thereof are omitted.

The polishing device 2 according to the present embodiment polishes the polishing target 110 described in the second embodiment. The polishing device 2 has a light source 40 and the sensor 26 provided on the polishing table 11. The light source 40 irradiates a surface of the polishing target 110 with red light during polishing. The red light passes through the polishing pad 12 and the slurry 200, and is reflected by the surface of the polishing target 110. The reflection light is received by the sensor 26.

The sensor 26 outputs the quantity of the received light to the end point detector 27. In accordance with the quantity of the received light, that is, the quantity of light reflected by the surface of the polishing target 110, the end point detector determines whether or not the end point condition is satisfied.

When the light source 40 irradiates the polishing target 110 with red light, the light quantity of reflection light thereof varies according to the surface state of the wiring layer 115 of the polishing target 110. With progress of polishing, the Cu area rate of the wiring layer 115 covering the surface of the polishing target 110 decreases so that the light quantity of the reflection light decreases. The light quantity of the reflection light depends on incident light, that is, the quantity of light from the light source 40. With increase in the cumulative use time of the light source 40, the quantity of light from the light source 40 decreases due to aged deterioration.

Therefore, in the present embodiment, the cumulative use time of the light source 40 is inputted as the device information to the end point condition setter 30 at step S1. The calculation processor 31 sets a threshold light quantity as the end point condition according to the cumulative use time of the light source 40 at step S2. When the cumulative use time of a light source lamp becomes longer, the threshold light quantity becomes smaller.

Thereafter, the sensor 26 senses the light quantity of the reflection light as the characteristic value at step S5. When the light quantity of the reflection light is lower than the threshold light quantity, the end point detector 27 determines that the end point condition is satisfied at step S6.

According to the aforementioned present embodiment, the calculation processor 31 optimizes the threshold of the reflection light quantity as one kind of the end point condition, in accordance with the cumulative use time of the light source 40 as one kind of the device information. Consequently, a detection error of the end point detector 27 caused by aged deterioration of the light source 40 becomes small so that excessive/deficient polishing can be avoided.

The color of light from the light source 40 is not limited to red. The optical value sensed as the characteristic value by the sensor 26 is not limited to the light quantity of the reflection light either. For example, the light source 40 may irradiate the surface of the polishing target 110 with white light. In this case, the sensor 26 senses the spectrum value of the reflection light as the characteristic value.

In the aforementioned first to eighth embodiments, at least a part of setting of the end point condition performed by the end point condition setter 30 may be configured by software. When such a part is configured by software, a program for realizing the function of at least a part of setting of the end point condition may be stored in a non-transitory record medium such as a flexible disk, a magnetic disk, or an optical disk, and be read by a computer so as to be executed. The record medium is not limited to an attachable/detachable medium such as a magnetic disk or an optical disk, and may be a fixed-type record medium such as a solid state drive device, a hard disk device, or a memory element.

The program for realizing the function of at least a part of setting of the end point condition may be distributed over a communication channel (including wireless communication) such as the internet. Further, the program may be distributed, in a state of being encrypted, modulated, or compressed, over a wired channel or a wireless channel such as the internet or by being stored in a non-transitory record medium.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A polishing device which polishes a surface of a polishing target, the device comprising:

a sensor configured to sense a characteristic value correlated with a state of the surface during polishing;

an end point detector configured to detect that the characteristic value or a polishing time satisfies an end point condition corresponding to an end point of the polishing; and an end point condition setter configured to set the end point condition in accordance with a functional expression using at least one of device information about the polishing device and polishing target information about the polishing target as a parameter and to output the set end point condition to the end point detector, wherein the end point condition is the threshold, the maximum time, an elapsed time from detection of the threshold, an average section for smoothing a current waveform including noise, a section for calculating the gradient of a current waveform, and the average section of the gradient, a detection condition of detecting a decrease start point or an increase start point of the waveform of the characteristic value.

2. The polishing device according to claim 1, further comprising:

a polishing pad to polish the surface; and a dresser to grind the polishing pad, wherein a use state of the polishing pad, a use state of the dresser, or a grinding rate of the polishing pad is inputted as the device information to the end point condition setter.

3. The polishing device according to claim 1, wherein the characteristic value or the polishing time detected so far by the end point detector is inputted as the device information to the end point condition setter.

4. The polishing device according to claim 1, wherein at least one of a film thickness, a surface step, a warp amount, and a pattern length of the polishing target is measured in advance, and the measured value is inputted as the polishing target information to the end point condition setter.

5. The polishing device according to claim 1, wherein history information indicating a polishing history of the polishing device is inputted as the device information to the end point condition setter.

6. The polishing device according to claim 1, further comprising:

a polishing pad to polish the surface;

a polishing table provided with the polishing pad; and a table drive mechanism to drive the polishing table, wherein the sensor senses, as the characteristic value, drive current of the table drive mechanism.

7. The polishing device according to claim 1, further comprising a light source to irradiate the surface with light during polishing, wherein the sensor senses, as the characteristic value, an optical value concerning reflection light of the light reflected by the surface, and the end point condition setter sets the end point condition in accordance with the device information indicating a cumulative use time of the light source.

8. The polishing device according to claim 1, a history of the polishing target polished so far by the polishing device is inputted as the device information to the end point condition setter.

9. The polishing device according to claim 1, wherein information about a design layout on the surface of the polishing target is inputted as the polishing target information to the end point condition setter.

10. A polishing method comprising:

automatically setting an end point condition which corresponds to an end point of polishing performed by the polishing device, in accordance with a functional expression using at least one of device information about a polishing device and polishing target information about the polishing target as a parameter;

polishing the surface of the polishing target with the polishing device;

sensing the characteristic value correlated with the state of the surface during the polishing; and ending the polishing when detecting that the characteristic value satisfies the end point condition, wherein the end point condition is the threshold, the maximum time, an elapsed time from detection of the threshold, an average section for smoothing a current waveform including noise, a section for calculating the gradient of a current waveform, and the average section of the gradient, a detection condition of detecting a decrease start point or an increase start point of the waveform of the characteristic value.

11. A non-transitory record medium recording a program to be executed by a computer which is connected to a polishing device including a sensor to sense a characteristic value correlated with a state of a surface of a polishing target during polishing of the surface and including an end point detector to detect that the characteristic value satisfies an end point condition corresponding to an end point of the polishing, the program comprising:

automatically setting the end point condition in accordance with a functional expression using at least one of device information about the polishing device and polishing target information about the polishing target as a parameter, and outputting the set the end point condition to the end point detector, wherein the end point condition is the threshold, the maximum time, an elapsed time from detection of the threshold, an average section for smoothing a current waveform including noise, a section for calculating the gradient of a current waveform, and the average section of the gradient, a detection condition of detecting a decrease start point or an increase start point of the waveform of the characteristic value.

12. The polishing device according to claim 1, wherein the end point condition setter includes a calculation processor including a CPU (central processing unit) that operates in accordance with a predetermined program, and a storage including a semiconductor memory having the program, and the calculation processor sets a threshold or a maximum polishing time according to a polishing form, and the calculation processor determines the end point condition in accordance with at least one of the device information and the polishing target information.

* * * * *